United States Patent [19]

Nygaard et al.

[11] 4,267,567

[45] May 12, 1981

[54] ELECTRIC IGNITER

[75] Inventors: Kurt Nygaard; Kjell Mattsson; Sven-Erik Bratt, all of Karlskoga, Sweden

[73] Assignee: Aktiebolaget Bofors, Bofors, Sweden

[21] Appl. No.: 895,181

[22] Filed: Apr. 10, 1978

[30] Foreign Application Priority Data

Apr. 19, 1977 [SE] Sweden ..... 7704435

[51] Int. Cl.[3] ..... F42B 9/08

[52] U.S. Cl. ..... 362/46; 362/203

[58] Field of Search ..... 102/28 R, 46, 203

[56] References Cited

U.S. PATENT DOCUMENTS

| | | | |
|---|---|---|---|
| 3,541,961 | 11/1970 | Larsen | 102/28 R |
| 3,682,096 | 8/1972 | Lüdke et al. | 102/28 R |
| 3,867,885 | 2/1975 | Gawlick et al. | 102/28 R |
| 3,971,320 | 7/1976 | Lee | 102/28 R |
| 4,103,619 | 8/1978 | Fletcher et al. | 102/28 |

FOREIGN PATENT DOCUMENTS

| | | | |
|---|---|---|---|
| 1209927 | 1/1966 | Fed. Rep. of Germany | 102/28 R |

*Primary Examiner*—Harold J. Tudor

*Attorney, Agent, or Firm*—Pollock, Vande Sande & Priddy

[57] ABSTRACT

An electric igniter is disclosed which comprises two elements made of electrically conducting material, a body separating the elements and made of electrically insulating material, such as glass or material containing glass, at least one further electrically conducting element arranged on a surface common to the two elements and the body for connecting the two elements electrically, and also a pyrotechnical composition in contact with the surface and the further element. Burning of the composition can be initiated by means of heat developed in the further, initiating element.

16 Claims, 8 Drawing Figures

ELECTRIC IGNITER

BACKGROUND OF THE INVENTION

Electric igniters are used in various kinds of ammunition where an electric source of power is relied upon to achieve an initiating action of some kind. For example, an electric igniter may be included in an electric initiating system for initiating a bursting charge in a projectile, in which an electrically charged capacitor is connected to the electric igniter by an impact contact or a similar activation means.

In modern ammunition, it is essential that the various operational processes of the device take place exactly according to a predetermined and desired pattern so that the desired results may be achieved. As far as an electric igniter is concerned, this means that the initiating effect should be complete within a predetermined time, which sometimes is only a few microseconds.

In order to achieve very rapid initiation, prior art devices have included the so-called conducting composition igniter, in which the electrically conducting element in principle consists of graphite powder or the like mixed into the contacting pyrotechnical composition. The variation in sensitivity of conducting composition igniters in such that certain igniters can have such a high sensitivity that the risk for accidental ignition is a major problem. If the electrically conducting element instead is made in the form of a metal wire, in order to obtain the rapidity required it is necessary to use very thin wires having dimensions of $5\times10^{-6}$m or thinner. Such thin wires introduce considerable manufacturing problems and are vulnerable to mechanical damage.

SUMMARY OF THE INVENTION

The present invention solves the above-mentioned problems and comprises an electrically conducting initiating element formed of a thin metal layer which has such a little mass that the necessary rapidity can be obtained and at the same time is so firmly fixed, not only to the metal elements involved but also to the insulating body, that great mechanical strength is obtained for the element itself and its fastening points.

In accordance with the invention, the metal layer is applied directly to a finely processed surface, which not only gives the possibility of economical production, but also contributes towards extremely good resistance to, inter alia, great shock stresses, compared to to previously known igniters. Electric igniters of this kind may be subjected, for example, to lateral accelerations as great as 80,000 g and more.

In the electric igniter, according to the invention, great emphasis has been placed on being able practically to determine the exact resistances and heat generation values of the electric circuit elements, particularly for the element which achieves the actual initiating function. The determining of the exact resistances forms the basis for the calculation of the electric power required, the heat generation in the element, the response time of the circuit, and so forth, which must be known for each particular application of the invention.

A characteristic feature of the invention is thus that the two elements and the insulating body are firmly joined together to achieve mechanically strong connections and their materials are chosen with coefficients of expansion which make the connections substantially independent of temperature variations within a predetermined temperature interval. The surface common to the two elements and the insulating body has a high degree of surface smoothness. The initiating element comprises at least one very thin metal layer which is applied directly to the surface and is fixed to both the material of the two elements and the material of the insulating body. The pyrotechnical composition is in direct contact with the initiating element and the surface under great pressure.

In addition to solving the above-mentioned problems, the electric igniter according to the invention can be made with very small external dimensions, such as 3 mm diameter and 4 mm length.

BRIEF DESCRIPTION OF THE DRAWINGS

An embodiment of the invention will be described in the following, with reference to the accompanying drawings, in which.

DETAILED DESCRIPTION OF THE PREFERRED EMBODIMENTS

Figure 1:
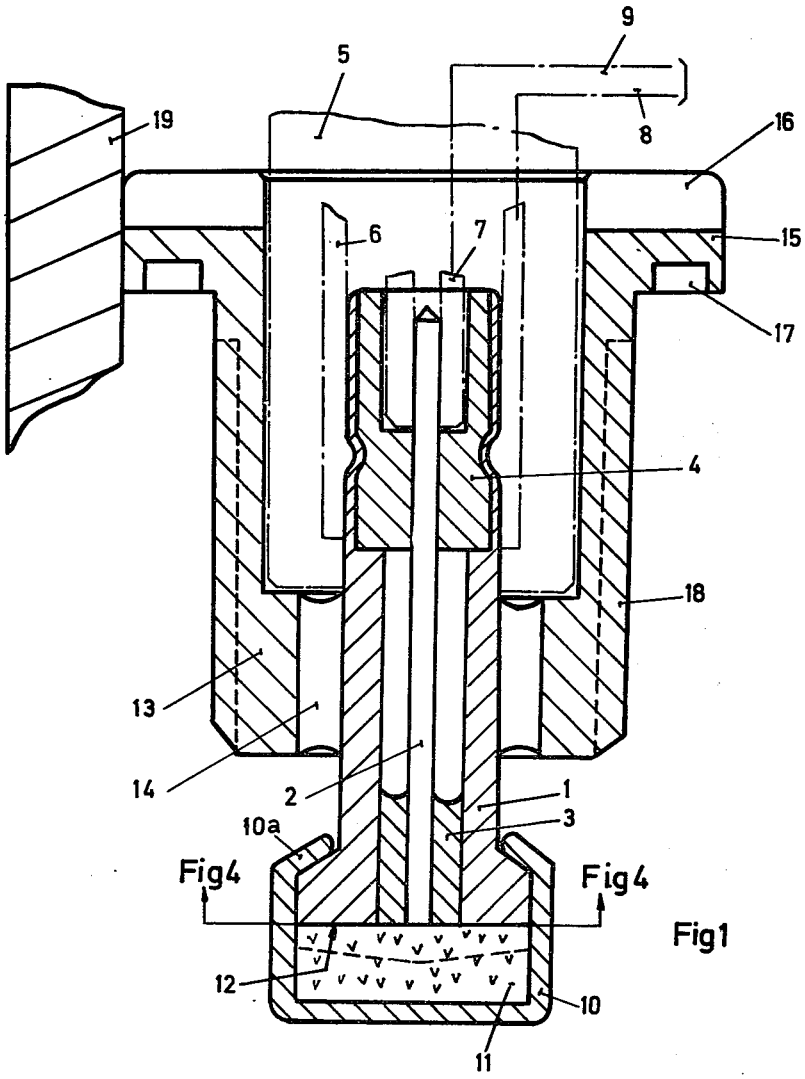
FIG. 1 shows a vertical section of an embodiment of an electrical igniter embodying the invention.

In FIG. 1, a first conductive element 1 is provided in the form of a sleeve, of chromium steel or other electrically conducting material. Coaxially inside the sleeve is arranged a second conductive element 2 in the form of an elongate bar of iron or nickel alloy or other electrically conducting material. Elements 1 and 2 are fixed to each other at their ends by means of a first electrically insulating body 3, substantially of glass, porcelain, or the like, and a second electrically insulating body 4 of plastic or the like. The sleeve forming element 1, together with the insulating body 4, is shaped at its upper end for so-called coaxial connection with a coaxial connection device 5 shown in phantom the outer and inner electric contacts 6, 7 of which are connected to two electric conductors 8, 9, via which connection takes place to a source of power not shown. Coaxial connection device 5 is made to be snapped on to the sleeve of element 1 which has a small recess intended for this purpose.

The lower part of element 1 is widened, to provide for the application of a capsule 10 which contains a pyrotechnical composition 11, of a kind which is known in itself. Elements 1 and 2 and insulating body 3 are provided with a common flat end surface 12, on which are arranged the metal layers not shown in detail in FIG. 1. The pyrotechnical composition is pressed against the metal layers and the end surface 12 with a comparatively great pressure.

The sleeve-formed element 1, in turn, is supported in a frame part 13 via a further electrically insulating body 14, of glass, plastic or similar material. At its upper part, the frame part has a recess for the coaxial connection device 5. The frame part is moreover made with a protruding flange 15 having a socket head 16 and a recess 17 for a sealing ring not shown in detail. Externally, the frame part has threads 18, via which the electric igniter frame thus obtained can be screwed into an assembly part in a projectile, rocket, bomb, or the like, of which only a portion 19 is shown. Through the arrangement shown, the electric connection to elements 1 and 2 is electrically isolated in relation to portion 19, which is essential from the point of view of jamming. For example, an electrostatic charge in the goods cannot be made to initiate the electric igniter.

Figure 2:
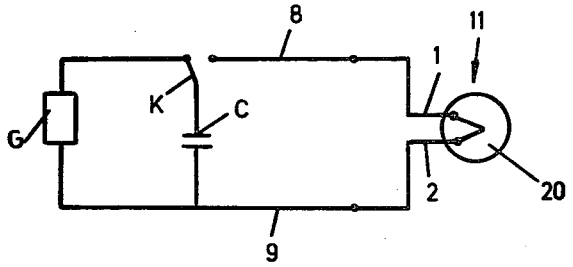
FIG. 2 schematically shows an electric circuit comprised in the electric igniter according to FIG. 1.

In accordance with FIG. 2, next to composition 11 and between the elements 1, 2, an initiating element 20 is arranged which electrically connects elements 1, 2. In the projectile, shell, or the like, the electric igniter can be connected via its electric conductors 8 and 9 to a power storing means in the form of a capacitor C via a switch K which, for example, may be an impact switch of a kind which is known in itself. Capacitor C can be charged by means of a battery, an electric generator G, or the like, which, for example, can be activated when the projectile or the like is fired from the barrel. When said impact switch is activated and thus switches over from the position shown in FIG. 2 and makes contact with the conductor 8, the capacitor is discharged over the electric circuit which is formed by the electric conductors 8, 9, elements 1, 2 and initiating element 20. By means of the initiating element according to the invention, it is possible to determine exactly the resistive properties and, accordingly, the total resistance in the circuit formed by the conductors 8, 9, elements 1, 2 and initiating element 20. It will thereby be possible to adapt the capacitance, voltage, and so forth exactly to each application for which the electric igniter is to function.

Figure 3:
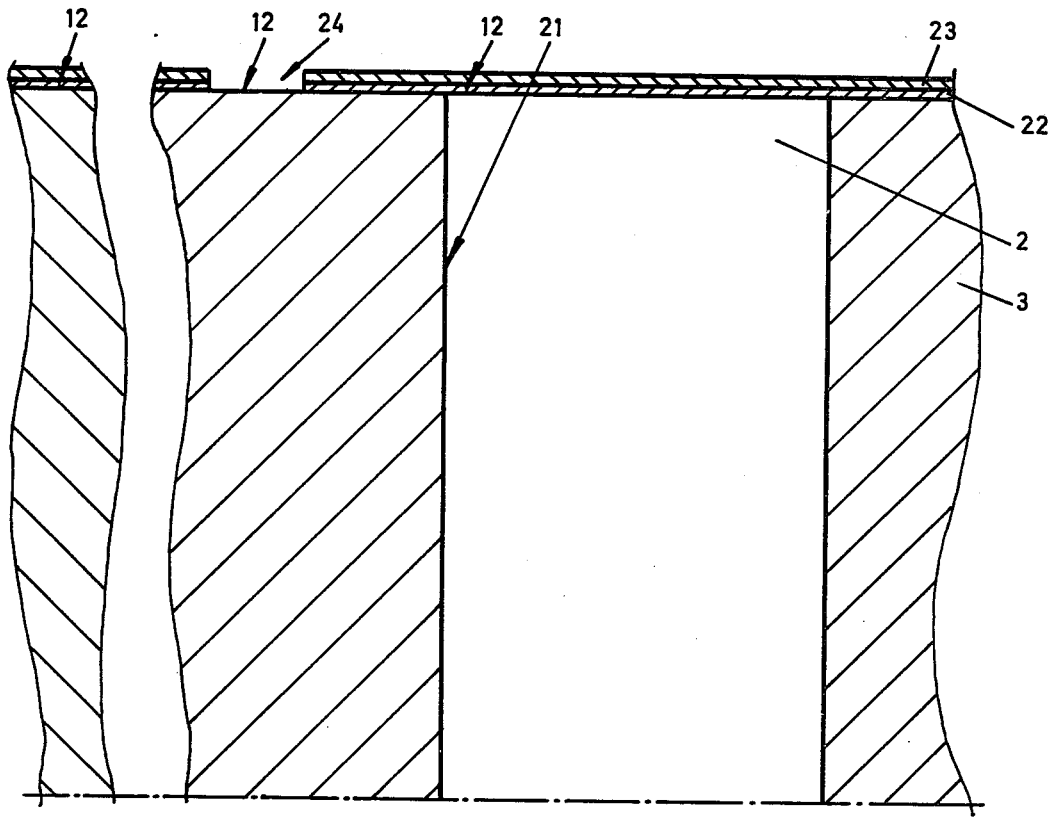
FIG. 3 shows an enlarged vertical section of parts of the electric igniter according to FIG. 1, FIG. 4 in a view from above shows an enlargement of the parts according to FIGS. 1 and 3 taken along line 4—4 of FIG. 1.
Figure 5:
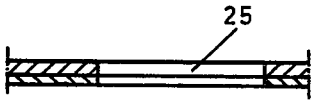
FIG. 5 shows an enlarged vertical section of the electric igniter according to FIG. 4, taken along line 5—5 of FIG. 4.

FIG. 3 shows in detail the design of element 2, and of the insulating body 3 at end surface 12, and also the metal layers applied to surface 12, by means of which the connection between the units is achieved. The end surface 12 is assumed to extend uninterrupted along the end surfaces of element 1, 2 and the insulating body 3. According to the concept of the invention, the mechanical connections 21 between the body 3 which is substantially made of glass and elements 1, 2 are to be made with very great mechanical strength, at least adjacent to surface 12. This mechanical strength is achieved by means of a strong joining of the material of elements 1 and 2 and body 3 which joining can be achieved by forming body 3 in a molten state between elements 1 and 2. Moreover, elements 1, 2 are made from such metals that a good wetting effect is obtained for the material (glass) of body 3 at its melting in between elements 1, 2. In certain cases, this good wetting effect can be obtained by appropriate thicknesses being strived for of oxide layers which are formed. Elements 1, 2 and body 3 can also be arranged so that the body is clamped in to a predetermined desired degree between the elements. This clamping effect can be achieved by the elements and the body being chosen with somewhat different coefficients of expansion. In the case shown, the outer element 1 should appropriately be chosen with a somewhat higher and the inner element 2 with a somewhat lower coefficient of expansion than that of the body 3. In this way, the connections or joints between the units and the body will be very tight. A measure of the tightness is that the connections should be sealed against passage of helium gas that is they should to a very high degree be free from pores, cracks and the like. Likewise, the material elements 1, 2 and insulating body 3 must have such coefficients of expansion that the connections therebetween will remain substantially unaffected that is, they will remain tight in the temperature range within which the ammunition is intended to function. The temperature range in question can then be between $-40°$ C. and $+60°$ C. As examples of the coefficients of expansion may be mentioned $12\times10^{-6}/o_c$ for element 1; $9\times10^{-6}/o_c$ for element 2; and $11\times10^{-6}/o_c$ for body 3. The connection technique that fulfils the above-mentioned requirements is previously known in this respect, and can be obtained in the open market, and therefore will not be described in detail here. Surface 12 is moreover to be machined such as by grinding and polishing, so that a very smooth surface is obtained, for example with a smoothness of approx. $10^{-6}$ m. Directly on finished surface 12 are applied very thin superimposed layers of metal, of which the first, or lower metal layer 22 is assumed to comprise chromium or a chromium alloy, in order to achieve maximum adhesion between elements 1, 2 and body 3. The second or upper metal layer 23 comprises gold or the like, which substantially forms the electrically conducting layer, and through the material chosen obtains a high degree of corrosion resistance. In an example of the embodiment the first layer has a thickness of approx. $2\times10^{-8}$ m and the second layer has a thickness of approx. $10^{-7}$ m. The tightness of the mechanical connections 21 and the surface smoothness of the surface 12 are chosen in relation to the thicknesses of the metal layers 22 applied directly on the surface. Thus, the connections 21 must not cause electric interruptions in the metal layers and the unevenness of surface 12 must not be of such a degree that an interruption may arise in the conducting metal layers when the pyrotechnical composition lies pressed against the metal layer and the surface 12. The metal layer 22 is assumed to be fixed both to the material of elements 1, 2 and to the material of body 3 along the entire surface which it covers.

Figure 4:
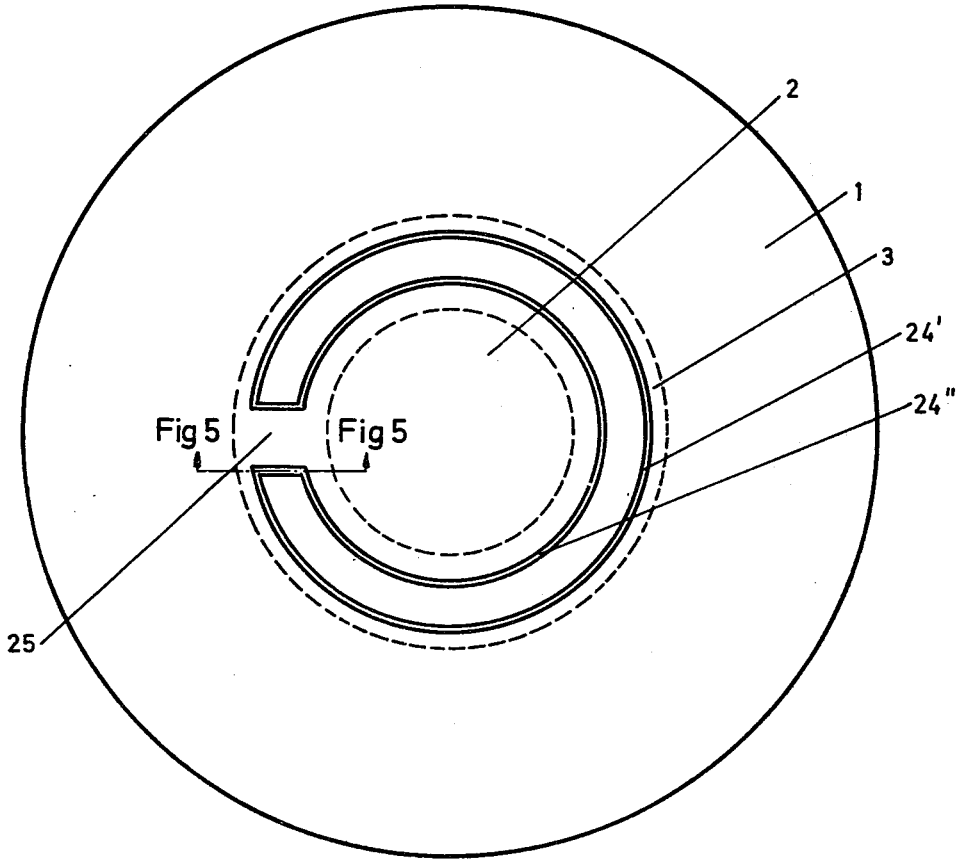
FIG. 4*a* shows a partial plan view of a modification of the parts according to FIG. 4.

The metal layers can be applied direct on the surface 12 by being allowed to vapourize on it under vacuum, using conventional vacuum deposition techniques. It is then possible to choose between vapourizing the metal on to the entire surface, or masking off part of it so that the metal layer will be applied only on selected sections of the surface. In the case when metal is applied to the entire surface, interruptions should subsequently be made deliberately in certain parts of the metal layers, so that a specific bar or the like forming initiating element 20 is obtained between elements 1 and 2. In FIG. 3, a point of interruption in the metal layer is indicated by 24. In FIG. 4, ring-formed interrupting grooves in the metal layer are indicated by 24' and 24''. These interrupting grooves are arranged at the surface above the insulating body 3. The ring-shaped interrupting grooves are then arranged so that one single bar-shaped initiating element 25 is obtained between elements 1 and 2. It is, of course, possible to utilize a plurality of a bar-shaped elements, and the rectangular shaped elements shown in the horizontal view and in the vertical section in FIGS. 3, 4 and **4*a*** can also be given other forms. It is also possible to utilize the entire layer as the contact conducting element, and thus omit said interrupting grooves, even if in such a case it is more difficult to achieve the exact determining of resistance as is possible in the case with individual bar-shaped elements. The cutting out of the bars can be done in a way which is known in other, corresponding situations, particularly with a laser.

Figure 4A:
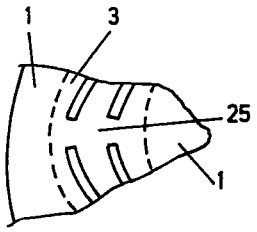

In the case shown, a connection element is obtained of which the resistive and heat releasing properties can be determined in advance with great exactness. The width, length and thickness of initiating element 25 are easy to determine, and as the element need not be applied to the units with any special soldering or welding procedure, it is possible to obtain a very great manufacturing precision of the individual electric igniters even at bulk production. As the metal layer according to the new electric igniter is applied directly on the surface and is fixed along its entire length to elements 1, 2 and body 3, extremely great strength of the element itself is obtained. In the examples of embodiments according to FIGS. 4 and 4*a*, the bar in question has been cut out of the parts of the metal layer which are located above the body 3, so that the metal layers extend circumferentially in over and well cover the connections or joints between elements 1, 2 and body 3. In this way, electric interruptions owing to any random interruption in the metal layer are efficiently eliminated. This should be contrasted to the case when a narrow bar extends over the joints.

The pyrotechnical composition 11, which in the present example of the embodiment comprises an ignition charge of silver azide or lead azide (nearest the surface) and hexogen or penthrite for a bursting charge in the projectile in question, can be pressed into place against the surface 12 with metal layers 22, 23 and initiating element 25 in between. The composition is in contact with the surface with great pressure which can assume values of up to 100 MPa, and can be within the range of 30–100 MPa for example.

The pressing of the composition into place against the surface 12 can be accomplished in a way which is known in itself in a pressing machine where the composition 11 is placed in the capsule 10, or vice versa, and the capsule 10 is folded with the upper part 10*a* over the widened part of element 1 so that the high contact pressure will remain. The grains in the composition are then pressed together compactly, and a very reliable construction, resistant to mechanical shocks, is thereby obtained. The grain size in the composition can be chosen within the range of $20–150\times10^{-6}$ mm (although often also granulated) and practical tests have shown that the electrical function via the metal layers is obtained notwithstanding the high pressing pressure.

Figure 6:
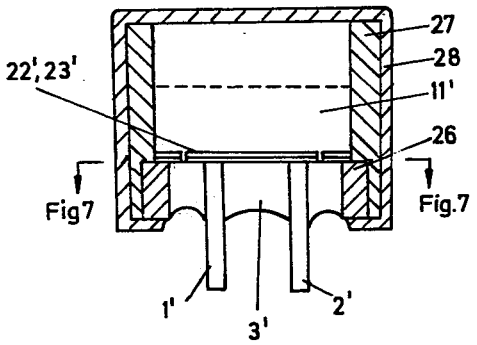
FIG. 6 shows a vertical section of another electrical igniter embodying the invention.
Figure 7:
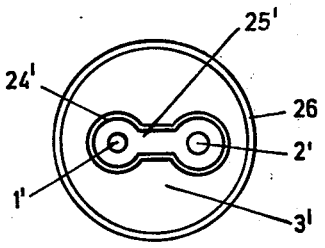
FIG. 7 shows a plan view of the embodiment according to FIG. 6, taken along line 7—7 of FIG. 6.

FIGS. 6 and 7 show another embodiment in which two metal pins 1' and 2' are encapsulated in a glass body 3' or the like. In this case there is also a casing 26 which can be grounded or ungrounded in relation to the material of the projectile in question. Also in this case, the pyrotechnical composition 11' consists of two layers, of silver azide (nearest the surface) and hexogen. The pyrotechnical composition is enclosed in an inner ring 27 and the composition and the ring 27 are kept in place by means of a closing sleeve 28 which achieves the pressing force of the composition against an initiating element 25' provided on a finely finished surface as described above. A groove 24' defines the initiating element 25'. In the unit thus obtained, the electric power is connected between the pins 1' and 2'. For the rest, the unit shown in FIGS. 6 and 7 is made in the corresponding way as according to the example of the embodiment described above.

The invention is not limited to the embodiment described above as examples, but can be subject to modifications within the scope of the following claims.

We claim:

1. An improved electric igniter, comprising:

a first electrically conductive element having a first end surface;

a second electrically conductive element having a second end surface;

an electrically insulating body having a third end surface, said body joining and electrically isolating said first and second electrically conductive elements, the coefficients of thermal expansion of said body and said electrically conductive elements being such that the joints between said elements and said body remain tight independent of temperature variations in the range of −40° C. to +60° C., and that said body is clamped between said first and second elements in said temperature range, said first and second elements being formed from a material which has a good wetting effect when contacted by the molten materials of said body;

a flat surface extending across and including said end surfaces of said elements and said body;

at least one electrically conductive bridge element comprising a layer of electrically conductive material having a thickness of up to $12\times10^{-8}$ m., said layer being deposited directly on said flat surface to extend between said end surfaces of said first and second conductive elements and across said end surface of said body and being divided, by grooves extending through said layer to said flat surface, into at least one bar-shaped portion joining a first portion of said layer, said first portion being electrically connected to said first electrically conductive element, to a separate, second portion of said layer, said second portion being electrically connected to said second electrically conductive element; and a pyrotechnical composition directly contacting said bridge element under pressure, whereby when current is passed through said bridge element via said first and second electrically conductive elements, said bridge element generates sufficient heat to ignite said pyrotechnical composition.

2. An igniter according to claim 1 wherein said first element is cylindrical and is arranged coaxially around said second element.

3. An igniter according to claim 2, wherein said bar-shaped portion is located only above said body, and said first portion and said second portion extend across the respective joints between said body and said first and second electrically conductive elements, whereby interruptions of current moving through said bar-shaped portion are minimized.

4. An igniter according to claim 2, further comprising a surrounding frame within which said first element is coaxially arranged and electrically insulated, whereby electrical connection to said first and second electrically conductive elements may be made without electrical contact with said frame.

5. An igniter according to claim 1, wherein said first and second electrically conductive elements comprise metal pins encapsulated within said body.

6. An igniter according to claim 1, wherein said bar-shaped portion is located only above said body, and said first portion and said second portion extend across the respective joints between said body and said first and second electrically conductive elements, whereby interruptions of current moving through said bar-shaped portion are minimized.

7. An improved electric igniter, comprising:

a first electrically conductive element having a hollow cylindrical shape and a first end surface;

a second electrically conductive element positioned coaxially within said first electrically conductive element, said second element having a second end surface;

an electrically insulating body having a third end surface, said body joining and electrically isolating said first and second electrically conductive elements, the coefficients of thermal expansion of said body and said electrically conductive elements being such that the joints between said elements and said body remain tight independent of temperature variations in the range of $-40°$ C. to $+60°$ C.;

a flat surface extending across and including said end surfaces of said elements and said body;

at least one electrically conductive bridge element comprising a layer of electrically conductive material having a thickness of up to $12\times10^{-8}$ m., said layer being deposited directly on said flat surface to extend between said end surfaces of said first and second conductive elements and across said end surface of said body and being divided, by grooves extending through said layer to said surface, into at least one bar-shaped portion joining a first portion of said layer, said first portion being electrically connected to said first electrically conductive element, to a separate, second portion of said layer, said second portion being electrically connected to said second electrically conductive element; and a pyrotechnical composition directly contacting said bridge element under pressure, whereby when current is passed through said bridge element via said first and second electrically conductive elements, said bridge element generates sufficient heat to ignite said pyrotechnical composition.

8. An igniter according to claim 7, wherein said coefficients of expansion are chosen so that said insulating body is clamped between said first and second elements in said temperature range, and said first and second elements are formed from a material which has a good wetting effect when contacted by the molten material of said insulating body.

9. An igniter according to claim 7, further comprising a surrounding frame within which said first element is coaxially arranged and electrically insulated, whereby electrical connection to said first and second electrically conductive elements may be made without electrical contact with said frame.

10. An igniter according to claim 7, wherein said first and second electrically conductive elements comprise metal pins encapsulated within said body.

11. An igniter according to claim 7, wherein said bar-shaped portion is located only above said body, and said first portion and said second portion extend across the respective joints between said body and said first and second electrically conductive elements, whereby interruptions of current moving through said bar-shaped portion are minimized.

12. An improved electric igniter, comprising:

a first electrically conductive element having a first end surface;

a second electrically conductive element having a second end surface;

an electrically insulating body having a third end surface, said body joining and electrically isolating said first and second electrically conductive elements, the coefficients of thermal expansion of said body and said electrically conductive elements being such that the joints between said elements and said body remain tight independent of temperature variations in the range of $-40°$ C. to $+60°$ C.;

a flat surface extending across and including said end surfaces of said elements and said body;

at least one electrically conductive bridge element comprising a layer of electrically conductive material having a thickness of up to $12\times10^{-8}$ m., said layer being deposited directly on said flat surface to extend between said end surfaces of said first and second conductive elements and across said end surface of said body and being divided, by grooves extending through said layer to said surface, into at least one bar-shaped portion joining a first portion of said layer, said first portion being electrically connected to said first electrically conductive element, to a separate, second portion of said layer, said second portion being electrically connected to said second electrically conductive element; and a pyrotechnical composition directly contacting said bridge element under pressure, whereby when current is passed through said bridge element via said first and second electrically conductive elements, said bridge element generates sufficient heat to ignite said pyrotechnical composition.

13. An igniter according to claim 12, wherein said bar-shaped portion is located only above said body, and said first portion and said second portion extend across the respective joints between said body and said first and second electrically conductive elements, whereby interruptions of current moving through said bar-shaped portion are minimized.

14. An igniter according to claim 12, further comprising a surrounding frame within which said first element is coaxially arranged and electrically insulated, whereby electrical connection to said first and second electrically conductive elements may be made without electrical contact with said frame.

15. An igniter according to claim 12, wherein said first and second electrically conductive elements comprise metal pins encapsulated within said body.

16. An improved electric igniter, comprising:

a first electrically conductive element having a first end surface;

a second electrically conductive element having a second end surface;

an electrically insulating body having a third end surface, said body joining and electrically isolating said first and second electrically conductive elements, the coefficients of thermal expansion of said body and said electrically conductive elements being such that the joints between said elements and said body remain tight independent of temperature variations in the range of $-40°$ C. to $+60°$ C.;

a flat surface extending across and including said end surfaces of said elements and said body;

at least one electrically conductive bridge element comprising a lower layer of chromium deposited on said flat surface by vacuum vaporization with a thickness of about $2\times10^{-8}$ m. and an upper layer of gold similarly deposited with a thickness of about $1\times10^{-7}$ m., said bridge element extending between said end surfaces of said first and second conductive elements and across said end surface of said body; and a pyrotechnical composition directly contacting said bridge element under pressure, whereby when current is passed through said bridge element via said first and second electrically conductive elements, said bridge element generates sufficient heat to ignite said pyrotechnical composition.

* * * * *